US009145723B2

(12) United States Patent
Garrett, III et al.

(10) Patent No.: US 9,145,723 B2
(45) Date of Patent: Sep. 29, 2015

(54) MOVABLE PARTITION SYSTEMS AND HEADER STRUCTURES AND COMPONENTS THEREOF, AND RELATED METHODS OF INSTALLATION

(75) Inventors: John G. Garrett, III, Magna, UT (US); Tracy M. Knight, Kearns, UT (US)

(73) Assignee: WON-DOOR CORPORATION, Salt Lake City, UT (US)

( * ) Notice: Subject to any disclaimer, the term of this patent is extended or adjusted under 35 U.S.C. 154(b) by 527 days.

(21) Appl. No.: 13/183,250

(22) Filed: Jul. 14, 2011

(65) Prior Publication Data

US 2013/0014907 A1 Jan. 17, 2013

(51) Int. Cl.
*E05D 15/26* (2006.01)
*E05D 15/06* (2006.01)

(52) U.S. Cl.
CPC ..... *E05D 15/0652* (2013.01); *E05Y 2201/11* (2013.01); *E05Y 2600/626* (2013.01); *E05Y 2900/142* (2013.01); *Y10T 29/49826* (2015.01)

(58) Field of Classification Search
CPC ... E04B 2002/7483; E04B 2/82; E04B 9/003; E04B 2/00; E05D 15/06; E05D 15/0652; E06B 9/06; E06B 9/00; E06B 9/0607; E06B 9/0615; E06B 9/0653; E04D 13/15
USPC ..... 160/199, 206, 126, 201; 52/36.1, 29
See application file for complete search history.

(56) References Cited

U.S. PATENT DOCUMENTS 3,876,583 A * 4/1975 Lee et al. ..... 528/289
4,011,696 A * 3/1977 Klein ..... 52/39
4,294,054 A * 10/1981 Kuhr ..... 52/506.07
4,549,375 A * 10/1985 Nassof ..... 52/39
4,834,161 A 5/1989 Johnson et al.
4,924,929 A 5/1990 Johnson et al.
5,638,639 A 6/1997 Goodman et al.
5,697,131 A 12/1997 Hunt et al.
6,662,848 B2 12/2003 Goodman et al.
7,050,283 B2 5/2006 Field et al.
7,066,297 B2 6/2006 Goodman et al.
7,190,132 B2 3/2007 Goodman et al.
7,478,663 B2 1/2009 Goodman et al.
7,516,293 B2 4/2009 Baska et al.
7,656,129 B2 2/2010 Banta et al.
7,737,860 B2 6/2010 Banta et al.
7,740,046 B2 6/2010 Goodman et al.
7,782,019 B2 8/2010 Banta et al.
7,845,384 B2 12/2010 Goodman et al.
7,845,385 B2 12/2010 Goodman et al.
7,845,386 B2 12/2010 Coleman et al.

(Continued)

*Primary Examiner* — Katherine Mitchell
*Assistant Examiner* — Jeremy Ramsey
(74) *Attorney, Agent, or Firm* — TraskBritt

(57) ABSTRACT

Movable partition systems include a movable partition, a soffit positioned along an edge of a track, and a molding member engaged with the soffit opposite the track. The molding member is at least partially abutted against a wall and configured to be adjusted laterally relative to the soffit. Methods of installing a movable partition system include suspending a track from a support member, inserting an end of a soffit between first and second ends of a molding member, and coupling the soffit to an edge of the track or a wall of a header structure. Methods of forming a header structure for a movable partition include disposing a track for a movable partition at least partially in a header recess of a header structure, engaging a molding member with a soffit, and coupling the soffit with the track and between the track and a wall of the header structure.

20 Claims, 11 Drawing Sheets

(56) References Cited

U.S. PATENT DOCUMENTS

| | | | |
|---|---|---|---|
| 7,854,248 | B2 | 12/2010 | Coleman et al. |
| 7,874,341 | B2 | 1/2011 | Coleman et al. |
| 7,886,804 | B2 | 2/2011 | Goodman et al. |
| 7,926,538 | B2 | 4/2011 | Coleman et al. |
| 7,931,067 | B2 | 4/2011 | Goodman et al. |
| 2008/0115896 | A1 | 5/2008 | Goodman |
| 2010/0102764 | A1 | 4/2010 | Banta et al. |
| 2010/0214709 | A1 | 8/2010 | Hall et al. |
| 2010/0299889 | A1 | 12/2010 | George |
| 2011/0000625 | A1 | 1/2011 | George |
| 2011/0005689 | A1 | 1/2011 | Coleman et al. |
| 2011/0024061 | A1* | 2/2011 | Bell et al. ..... 160/199 |
| 2011/0036016 | A1 | 2/2011 | Knight et al. |
| 2011/0036509 | A1 | 2/2011 | Goodman et al. |
| 2011/0036513 | A1 | 2/2011 | Banta et al. |
| 2011/0061820 | A1 | 3/2011 | Coleman et al. |
| 2011/0088322 | A1 | 4/2011 | Coleman et al. |
| 2011/0093095 | A1 | 4/2011 | Goodman et al. |

* cited by examiner

MOVABLE PARTITION SYSTEMS AND HEADER STRUCTURES AND COMPONENTS THEREOF, AND RELATED METHODS OF INSTALLATION

TECHNICAL FIELD

Embodiments of the present invention relate to movable partition systems used for partitioning space within buildings, to components of such systems, and to methods of manufacturing and installing such partition systems and components of such systems.

BACKGROUND

Movable partitions are utilized in numerous situations and environments for a variety of purposes. Such partitions may include, for example, a movable partition comprising foldable or collapsible doors configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof.

Movable partitions may also be used to provide a security barrier, a fire barrier, or both a security barrier and a fire barrier. In such a case, the partition barrier may be configured to automatically close upon the occurrence of a predetermined event such as the actuation of an associated alarm. For example, one or more accordion or similar folding partitions may be used as a security barrier, a fire barrier, or both a security barrier and a fire barrier wherein each partition is formed with a plurality of panels connected to one another in a hinged manner. The hinged connection of the panels enables the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which is often located above the movable partition in a header assembly, until the partition extends a desired distance across the room.

FIG. 1 illustrates an example of a conventional header assembly of a movable partition system. The header assembly 10 is configured for a use with a fire door and is provided in a header recess 20 formed between two fire rated walls 30, which include an opening for the movable partition (not shown). The header assembly 10 includes rods 40 extending from a structural support 50 provided above the two fire rated walls 30. The rods 40 extend from the structural support 50 to a location proximate an overhead track 60 provided for the movable partition. One or more layers of plywood 70 are attached to the rods 40 extending from the support structure 50. The layers of plywood 70 extend longitudinally along the length of the movable partition and the overhead track 60. The layers of plywood 70 also extend laterally across the header recess 20 toward the two fire rated walls 30.

One or more layers of gypsum board 80 are provided between the overhead track 60 and the layers of plywood 70. The layers of gypsum board 80 also extend longitudinally along the length of the movable partition and the overhead track 60 and extend laterally across the header recess 20 to the two fire rated walls 30. Some of the layers of gypsum board 80 extend only partially across the header recess 20 in a lateral direction in order to provide a pocket for the overhead track 60. That is, some layers of gypsum board 80 extend longitudinally along a lateral side of the overhead track 60 and extend laterally between a lateral side of the overhead track and one of the two fire rated walls 30.

The layers of plywood 70 and gypsum board 80 are typically custom fitted onsite during installation of the movable partition. Because some of the measurements needed for custom fitting the layers of plywood 70 and gypsum board 80 are only obtained after other portions of a door assembly are installed, the installer often must leave the installation site to obtain fitted plywood 70 and gypsum board 80 for installation at another time.

DETAILED DESCRIPTION

Illustrations presented herein are not meant to be actual views of any particular movable partition system or component of a movable partition system, but are merely idealized representations that are employed to describe embodiments of the present invention. Additionally, elements common between figures may retain the same numerical designation.

As used herein, the term "substantially" means to a degree that one skilled in the art would understand the given parameter, property, or condition is met with a small degree of variance, such as within acceptable manufacturing tolerances.

As used herein, the terms "lateral" and "laterally" refer to a direction across a length of a member. In relation to a track of a movable partition system, "lateral" refers to a direction across the width of the track and at least substantially perpendicular to the length of the track.

As used herein, the terms "longitudinal" and "longitudinally" refer to a direction at least substantially parallel to a length of a member. In relation to a track of a movable partition system, "longitudinal" refers to a direction along the length of the track and at least substantially parallel to a direction of intended movement of a movable partition coupled with the track.

As used herein, relational terms, such as "first," "second," "over," "below," etc., describe elements when viewed from the perspectives shown in the figures and do not connote or depend on any specific preference, orientation, or order, except where the context clearly indicates otherwise.

Figure 1:
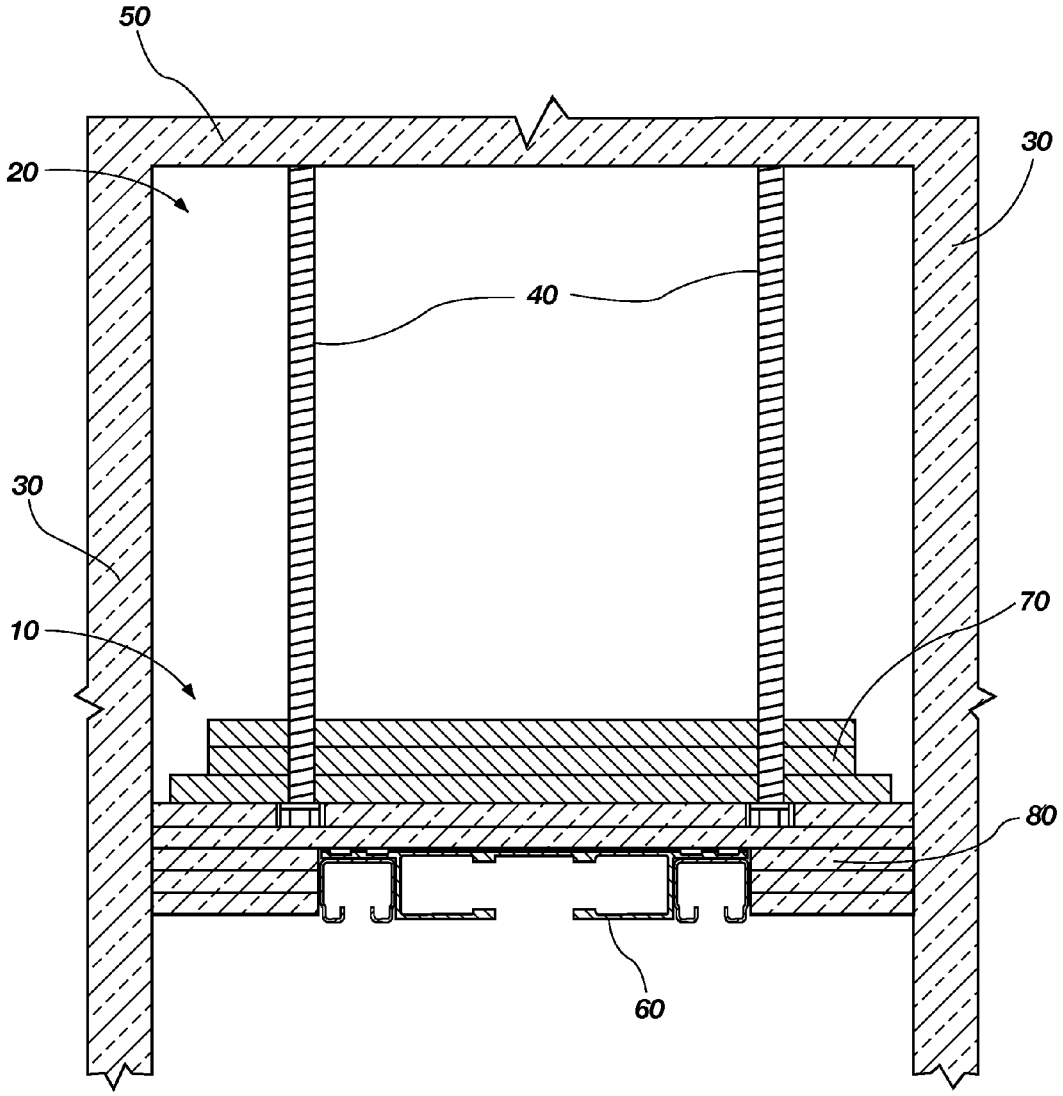
FIG. 1 (PRIOR ART)
FIG. 1 is a partial cross-sectional view of a conventional header assembly of a movable partition system installed within a building.
Figure 2:
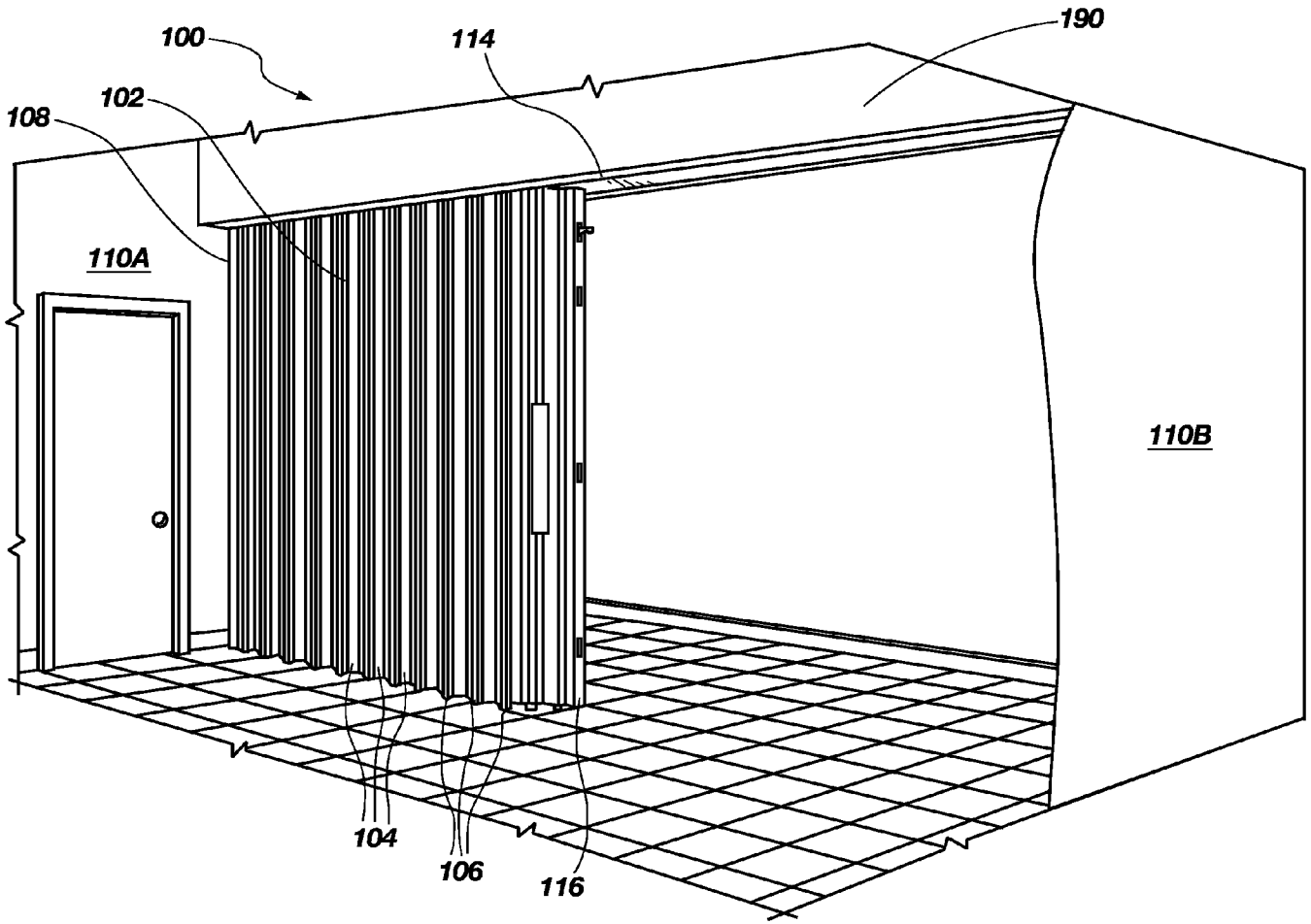
FIG. 2 is a perspective view of an embodiment of a movable partition system of the present disclosure installed in a building.

FIG. 2 illustrates an embodiment of a movable partition system 100 installed in a building. The movable partition system 100 may be an automatic movable partition system, in that the movable partition system 100 includes a movable partition 102 that may be automatically extended, automatically retracted, or both automatically extended and automatically retracted. The movable partition system 100 may include a movable partition 102 that may be manually extended, manually retracted, or both manually extended and manually retracted. The movable partition 102 may be used for partitioning space, as a sound barrier, as a fire barrier, as a security barrier, for combinations of such purposes, or for other purposes.

The movable partition 102 may include, for example, an accordion folding door, as shown in FIG. 2. The movable partition 102 may be formed with a plurality of panels 104 that are connected to one another with hinges or other hinge-like members 106. The hinged connection of the panels 104 enables the panels 104 to fold, and the movable partition 102 to collapse, as the movable partition 102 is retracted, which may enable the movable partition 102 to be compactly stored in a pocket 108 formed in a wall 110A of a building when in a retracted or folded state.

While embodiments illustrated and described with respect to the drawings of the disclosure are directed to a single accordion folding movable partition 102, other movable partitions may be used. For example, a two-door, or bi-part door, system may be utilized wherein two similarly configured doors extend across a space and join together to form an appropriate barrier. Also, the disclosure is applicable to movable partitions or barriers other than accordion folding doors, such as sliding doors.

The movable partition 102 may be suspended from (i.e., hang from) a track 114 along which the movable partition 102 moves as the movable partition 102 is expanded (i.e., closed) and retracted (i.e., opened). To deploy the movable partition 102 to an extended position, the movable partition 102 is moved along the track 114. A leading edge of the movable partition 102 may include a lead post 116 configured to engage with a door jamb or another post, which may be provided in a wall 110B of a building to which the movable partition 102 may extend in an extended state. The track 114 will be described in more detail hereinafter (see FIG. 3 and the accompanying description).

The movable partition system 100 may also include a header structure 190, which will be described in more detail hereinafter (see FIG. 4 and the accompanying description). The movable partition 102 may be suspended from and supported by the header structure 190. In other embodiments, the movable partition 102 may be supported by the floor or a track on the floor below the movable partition 102, and the header structure may simply serve as a guide for the movable partition 102. While the embodiment of the header structure 190 shown and described with reference to FIG. 2 protrudes into the space where the movable partition 102 is located, the header structure 190 may be partially or entirely located in an overhead structure in additional embodiments. For example, the header structure 190 may not protrude into the space where the movable partition 102 is located, but rather, may be located in an overhead structure such that the track 114 is mounted generally flush with the ceiling of the space.

Figure 3:
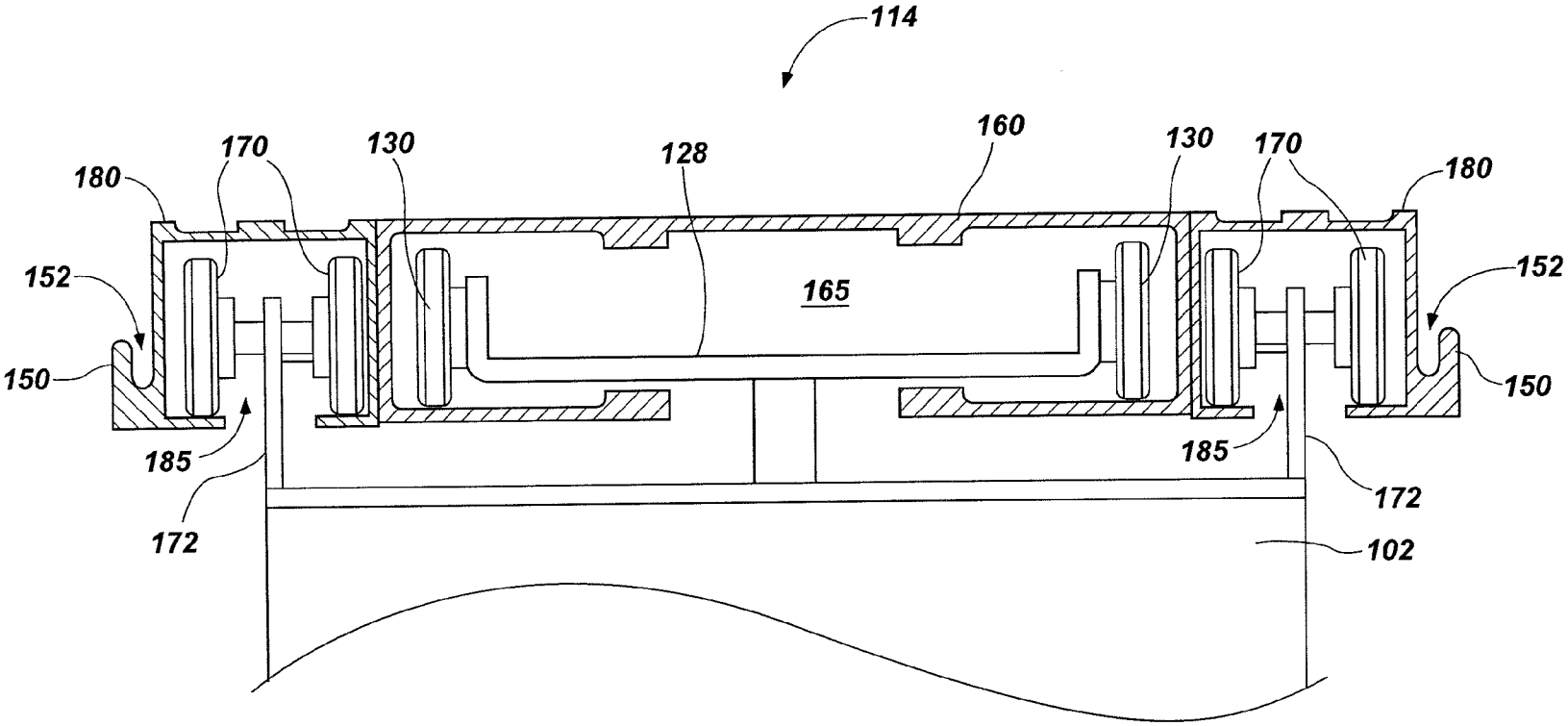
FIG. 3 is a partial cross-sectional view of an embodiment of a track of the movable partition system of FIG. 2.

FIG. 3 shows a cross-sectional view of a track 114 that may be used when accompanied with an embodiment of the present disclosure. A support system, such as the header structure 190, may include the track 114, which may include an elongated drive guide member 160 located generally centrally in the track 114, and two elongated roller guide members 180 disposed on opposite lateral sides of the elongated drive guide member 160. In some embodiments, the drive guide member 160 and roller guide members 180 may comprise separate bodies or structures that are attached to one another, or simply installed proximate one another. In other embodiments, the drive guide member 160 and roller guide members 180 may comprise different regions of a single, unitary body or structure. The track 114 of FIG. 3 is illustrated merely as an example of a type of track that may be used with movable partitions 102 of the present disclosure. Other types of tracks, such as a single- or dual-channel track, may be used, as will be appreciated by one skilled in the art.

The drive guide member 160 may comprise a generally hollow body having at least one internal surface defining a drive channel 165 that extends longitudinally through the drive guide member 160 and is located generally centrally in the track 114. Components of the movable partition system 100 may be disposed at least partially within the drive channel 165, such as: a drive trolley 128 coupled with the movable partition 102 (e.g., to the lead post 116); drive trolley rollers 130 (e.g., wheels) rotatably coupled with the drive trolley 128; an elongated drive member (e.g., a chain or a belt) (not shown); or any combination thereof. The drive trolley 128 may be coupled with the movable partition 102 to extend or retract the movable partition 102 along the track 114.

The roller guide members 180 may each comprise a generally hollow body having at least one internal surface defining an internal roller channel 185 that extends longitudinally through each roller guide member 180. The roller channels 185 may be partially defined by a bottom surface and innermost side surfaces internal to the roller guide members 180. Portions of the movable partition 102, such as, for example, the panels 104, may be suspended from (i.e., hang from) partition support members 172. The movable partition 102 may move along the track 114 by the rolling of partition support rollers 170 (e.g., wheels or bearings) rotatably coupled with the partition support members 172 and within the roller channels 185 in a direction at least substantially parallel to a direction of movement of the movable partition 102.

The track 114 may include a soffit attachment feature 150 along an outer, lateral edge of the track 114. The soffit attachment feature 150 may comprise a hook-shaped member extending longitudinally along an outer surface of the track 114. The hook shape of the soffit attachment feature 150 may form a slot 152 configured to receive a portion of a corresponding soffit therein.

Figure 4:
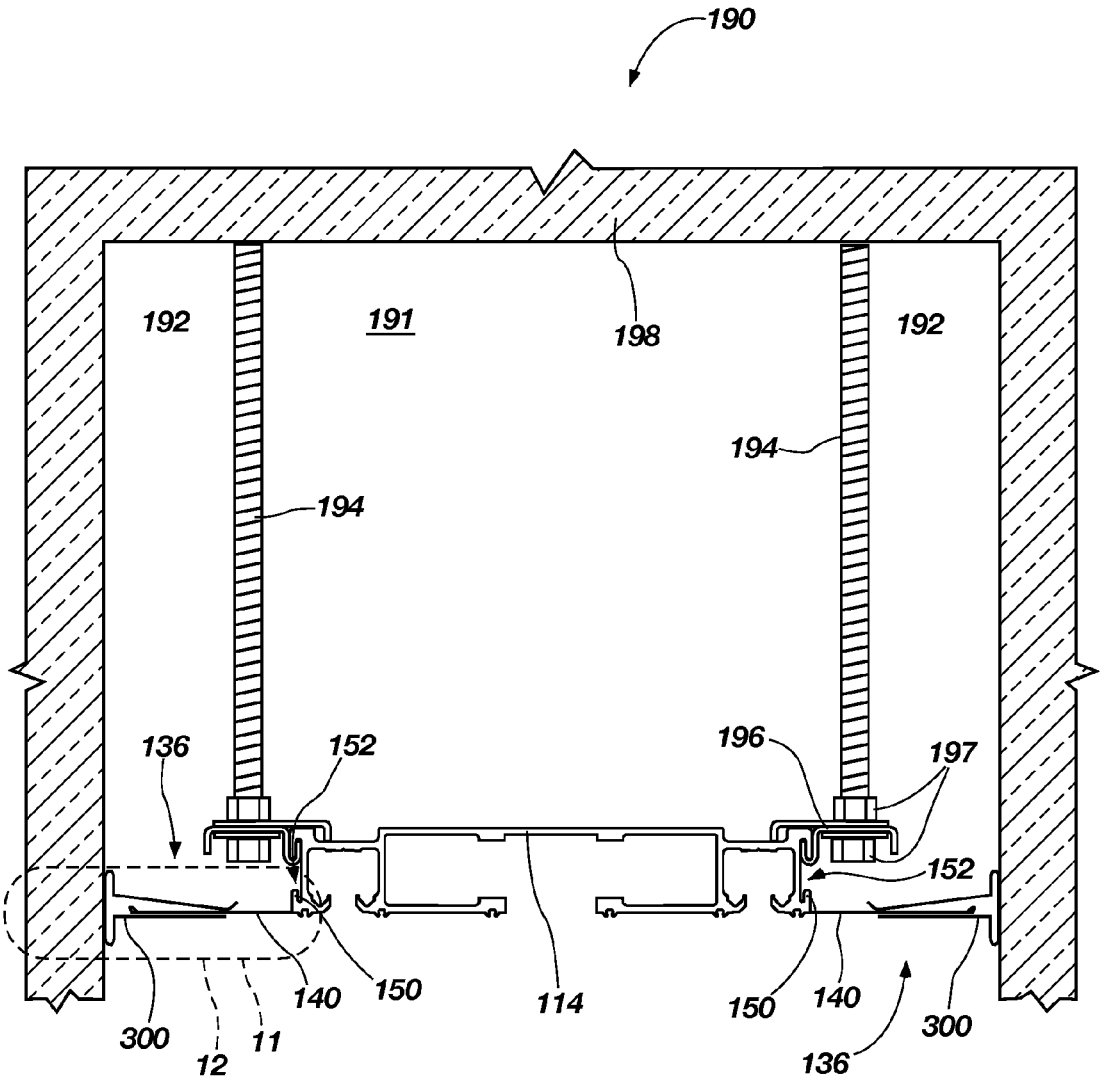
FIG. 4 is a partial cross-sectional view of an embodiment of a header structure of the movable partition system of FIG. 2.

Referring now to FIG. 4, the header structure 190 of the movable partition system 100 is shown in a partial cross-sectional view. In some embodiments, the header structure 190 for a movable partition 102 may include a track 114, as described in more detail hereinabove. The track 114 may be attached to a support member 198 by fastener elements such as rods 194. The support member 198 may be, for example, a wood or metal beam, a truss structure, floor joists, etc. One end of each of the rods 194 may be attached to the support member 198. Each rod 194 may comprise a threaded rod that extends through the support member 198, and a nut may be threaded onto the end of the support member 198 on a side thereof opposite the track 114 to retain the rod 194 in position relative to the support member 198.

The track 114 may be coupled with (directly or indirectly) and suspended from the rods 194. As shown in FIG. 4, the track 114 may be indirectly coupled with the rods 194 using structural elements 196. The ends of the rods 194 opposite the support member 198 may extend through a portion of the structural elements 196, and nuts 197 may be used to retain the structural elements 196 on the rods 194. The structural elements 196 may take the form of any of a number of well known and commercially available structural building and framing components. In some embodiments, the structural elements 196 may comprise elongated, at least substantially rectangular frame members. By the way of example and not limitation, the rods 194, the structural elements 196, and the nuts 197 may comprise components of a metal framing system commercially available from the UNISTRUT® Corporation of Wayne, Mich. The structural elements 196 may extend in sections or continuously along the length of the track 114 to support the track 114 and the movable partition 102 suspended therefrom.

In some embodiments, the rods 194 may be located at set distances along the track 114 to attach the structural elements 196 to the support member 198. For example, the rods 194 may be spaced at set intervals along the track 114, each interval being spaced a set distance such as 18 inches (45.72 centimeters) apart. Further, in some embodiments, when the movable partition 102 is retracted (i.e., opened), the weight of the movable partition 102 will be concentrated in a portion of the track 114 located above the retracted movable partition 102 (e.g., a section of the track 114 located in the pocket 108). Therefore, the rods 194 may be spaced at shorter intervals such as 12 inches (30.48 centimeters) in the area where the movable partition 102 is stored in a retracted state. While the track 114 of FIG. 4 is shown suspended from the support member 198 by the rods 194, the track 114 may be attached, suspended, or spaced from the support member 198 by any suitable manner including, but not limited to, attaching the track 114 or structural elements 196 directly to the support member 198.

A header recess 191 in the header structure 190 may be defined by internal surfaces of walls 192 and the support member 198 of the header structure 190. In some embodiments where the movable partition system 100 is implemented as a fire barrier, the walls 192 may be formed from a fire-resistant material. In some embodiments, such as where the track 114 is mounted generally flush with a ceiling, the walls 192 may be omitted.

For convenience and clarity, the following description refers only to the elements of the header structure 190 on the left side of FIG. 4. However, the elements of the header structure 190 shown on the right side of FIG. 4 may be configured substantially similarly to those on the left side. A soffit 140 may be coupled with the track 114 along an outer, lateral edge thereof to at least partially cover a space 136 between the track 114 and the wall 192. The space 136 may be covered for any of the following reasons, offered by way of example: to improve the aesthetics of the header structure 190 by smoothing the transition between the track 114 and a structural feature proximate thereto (e.g., the wall 192, a ceiling, etc.) and by covering up the nuts 197, the rods 194, and the structural elements 196; to improve a sound barrier created by the partition 102 coupled with the track 114; and to improve a fire barrier created by the partition 102 coupled with the track 114.

In some embodiments, the soffit 140 may be coupled with the track 114 with the soffit attachment feature 150 of the track 114. The soffit 140 may include a feature complementary to the soffit attachment feature 150 of the track 114. For example, a first lateral end 141 of the soffit 140 may include an attachment feature 146 configured to be received by the slot 152 formed by the hook shape of the soffit attachment feature 150 of the track 114. Complementarily, the soffit attachment feature 150 of the track 114 may be configured to be received by the attachment feature 146 of the soffit 140. The soffit 140 and the attachment feature 146 thereon are described in more detail hereinafter with reference to FIGS. 5 and 6.

A molding member 300 may be disposed at least partially between the soffit 140 and the wall 192, to at least partially cover the space 136 between the track 114 and the wall 192. The molding member 300 may be coupled with the soffit 140 and positioned to cover a portion of the space 136 left uncovered by the soffit 140. The molding member 300 may be engaged with the soffit 140 and may at least partially abut against the wall 192. Optionally, the molding member 300 may be secured to the wall 192, such as by a fastener (e.g., a bolt, a screw, a rivet, a clip, a wall mount, etc.) and/or an adhesive. However, in some embodiments, the molding member 300 may not be fastened to the wall 192; rather, the molding member 300 may abut against the wall 192 without being attached or fastened to the wall 192 using a fastener or an adhesive, for example.

The wall 192 may not extend perfectly parallel to the track 114 in a longitudinal direction. Defects in manufacturing the wall 192 may cause it to curve or otherwise deviate from a straight line. Based on these deviations, conventional header structures may include gaps or spaces between soffits and header walls or ceilings. Such gaps or spaces may cause problems with aesthetics, decreased fire or sound barriers, etc. The molding member 300 may be engaged with the soffit 140 so that it is able to be laterally adjusted relative to the soffit 140. The molding member 300 may also be capable of longitudinal adjustment relative to the soffit 140. However, movement of the molding member 300 perpendicularly away from a major plane of the soffit 140 (i.e., up and down with reference to FIG. 4) may be restricted by the form and engagement of the molding member 300 and the soffit 140. Engaging the molding member 300 with the soffit 140 in such an adjustable manner may eliminate or reduce the need to take measurements, strike chalk lines, employ a laser line, and/or otherwise calculate and locate the proper height of the molding member 300 to ensure alignment with the track 114 and to ensure coverage of gaps or spaces between the soffit 140 and the wall 192. Furthermore, a fastener (e.g., a rivet, screw, clip, wall mount, etc.) and/or an adhesive may not be needed to secure the molding member 300 against the wall 192. The molding member 300 may be engaged with (e.g., attached to) the soffit 140 before the soffit 140 is coupled with the track 114. The engagement of the molding member 300 with the soffit 140 is described in further detail hereinafter with reference to FIGS. 11 and 12. After the soffit 140 and the molding member 300 engaged therewith is installed proximate the track 114, the molding member 300 may be adjusted laterally by simply pushing it in a lateral direction toward the wall 192. Thus, installing a soffit 140 and molding member 300 that at least substantially completely covers the gap 136 between the track 114 and the wall 192 may be simplified using the molding member 300 and the soffit 140 of this disclosure compared to conventional methods. In other words, engagement of the molding member 300 to the soffit 140 aligns the molding member 300 to the track 114 and to the wall 192 when the soffit 140 is installed in the header structure 190 in a manner that reduces or eliminates a further need for calculations, adjustments, custom fitting, and/or fasteners.

Although the soffit 140 is shown in FIG. 4 coupled with the outer, lateral edge of the track 114 by the soffit attachment feature 150 and the molding member 300 abuts against the wall 192, the disclosure is not so limited. By way of example, in other embodiments, a soffit 140 may be coupled with the wall 192 with a soffit attachment feature thereon (not shown) or with another fastener instead of with the track 114. The molding member 300 may be positioned at least partially between the soffit 140 and the track 114. In other words, the disclosure is not limited to the particular orientation and configuration shown in FIG. 4.

The soffit 140, the molding member 300, and configurations of the soffit 140 and the molding member 300 are described in more detail below with reference to FIGS. 5 through 12.

Figure 5:
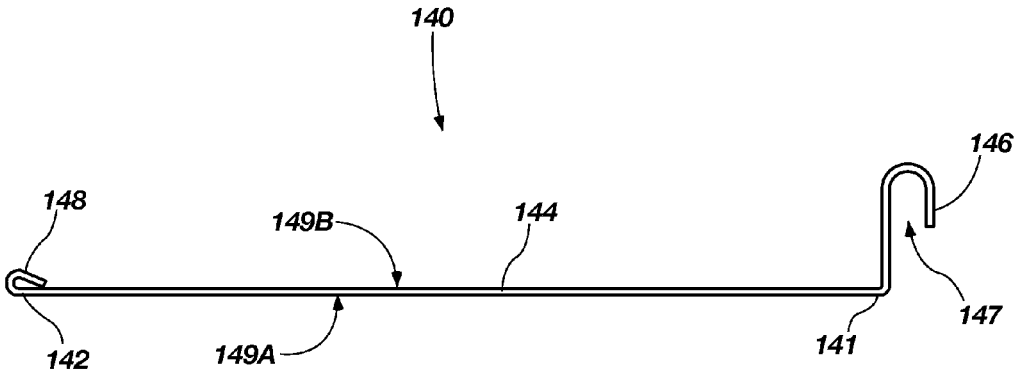
FIG. 5 is an end view of an embodiment of a soffit of the movable partition system of FIG. 2.
Figure 6:
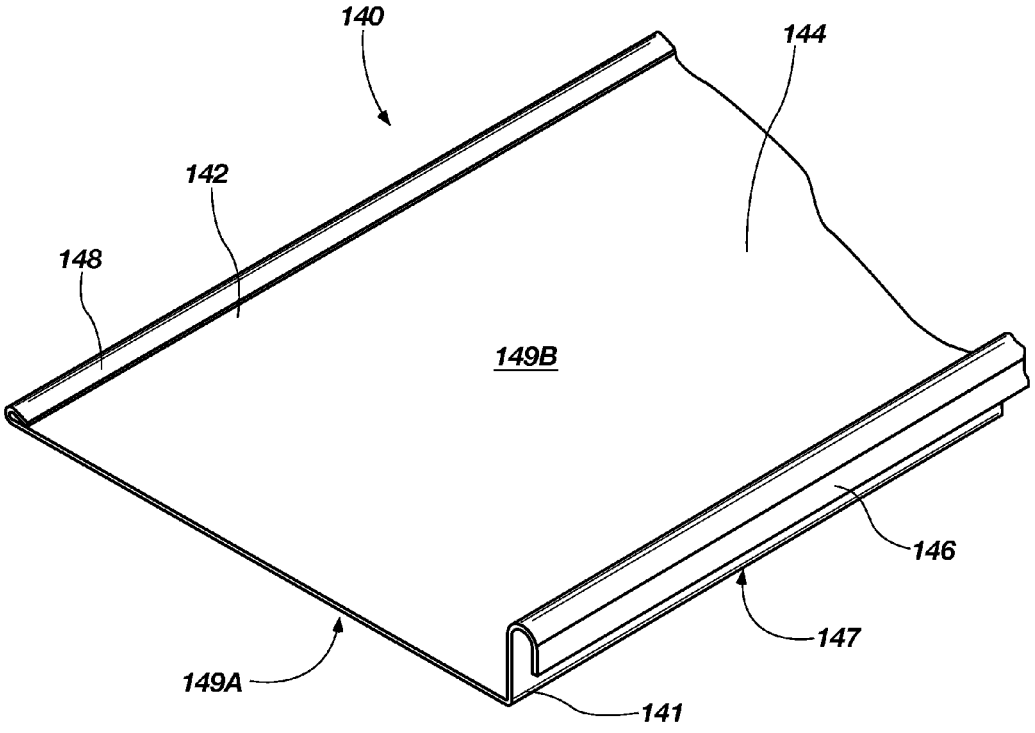
FIG. 6 is a partially cut-away perspective view the soffit of FIG. 5.

Referring now to FIGS. 5 and 6, an embodiment of the soffit 140 for the movable partition system 100 is illustrated, including a first lateral end 141, an at least substantially flat body portion 144, and a second lateral end 142. An attachment feature 146 may be included at the first lateral end 141. The attachment feature 146 may have a form that is complementary to the soffit attachment feature 150 of the track 114 (see FIGS. 3 and 4) enabling the soffit 140 to be coupled with the track 114. For example, the attachment feature 146 may have a hook shape. The hook shape of the attachment feature 146 may form a slot 147. The attachment feature 146 of the soffit 140 may be configured to be received by the slot 152 of the soffit attachment feature 150 of the track 114. Complementarily, the slot 147 of the soffit 140 may be configured to receive the soffit attachment feature 150 of the track 114. The body portion 144 of the soffit 140 may be at least substantially flat and may be configured to cover at least a portion of the space 136 between the track 114 and the wall 192 (see FIG. 4).

A fold 148 may optionally be included at the second lateral end 142 of the soffit 140. The fold 148 may improve the handling of the soffit 140 by forming a rounded edge. Furthermore, the fold 148 may be included to provide a raised portion to better maintain engagement between the molding member 300 and the soffit 140, as will be described in more detail hereinafter.

The size of the soffit 140 may be tailored to fit along a lateral edge of the track 114 and at least partially between the track 114 and a structure proximate the track 114 (e.g., the wall 192, a ceiling, etc.). By way of example and not limitation, the lateral width of the soffit 140 (i.e., the length from the first lateral end 141 to the second lateral end 142) may be in the range of from about 2 inches (5.08 cm) to about 4 inches (10.16 cm) and the longitudinal length of the soffit 140 may be in the range of from about 24 inches (60.96 cm) to about 144 inches (365.76 cm). In at least one embodiment, the lateral width of the soffit 140 may be about 3.2 inches (8.13 cm) and the longitudinal length of the soffit 140 may be about 120 inches (304.8 cm).

The soffit 140 may include a first surface 149A and a second surface 149B on an opposite side of the soffit 140 as the first surface 149A. As the first surface 149A may be exposed when installed in a header structure 190, at least portions thereof may optionally be painted, galvanized, or otherwise treated. Reasons for such surface treatment may include, for example, reducing wear and deterioration of the soffit 140, improving the aesthetics of the header structure 190 including the soffit 140, increasing fire resistance of the header structure 190, etc. The surface treatment may be tailored to aesthetically match or be complementary to the wall 192, the track 114, or a nearby ceiling, for example. At least portions of the second surface 149B may be similarly treated.

As illustrated in FIGS. 5 and 6, the soffit 140 may be formed from a single sheet of material. By way of non-limiting example, the material from which the soffit 140 is formed may be metal (e.g., steel, aluminum), ceramic, plastic, wood, or any combination thereof. For example, in at least one embodiment, the soffit 140 may be formed from a sheet of 24 gauge cold rolled steel. In another embodiment, the soffit 140 may be formed from a sheet of plastic, such as polyvinyl chloride (PVC). The particular function of the movable partition system 100 may drive the choice of material for the soffit 140. For example, where the movable partition system 100 is intended to be used as a fire barrier, the soffit 140 may be formed of a material that is fire resistant, such as a metal.

The soffit 140 may be formed by any suitable manufacturing technique, such as, for example, bending, molding, extruding, rolling, machining, etc. For example, in at least one embodiment, the fold 148 and the attachment feature 146 may be formed by bending portions of a single sheet of metal. By way of another example, one or more portions or features of the soffit 140 may be formed separately and later joined together. Such manufacturing techniques are known in the art and are not described in detail in this disclosure.

Various embodiments of a molding member 300, 400, 500 for use with the movable partition system 100 of the present disclosure are illustrated in FIGS. 7 through 10.

Figure 7:
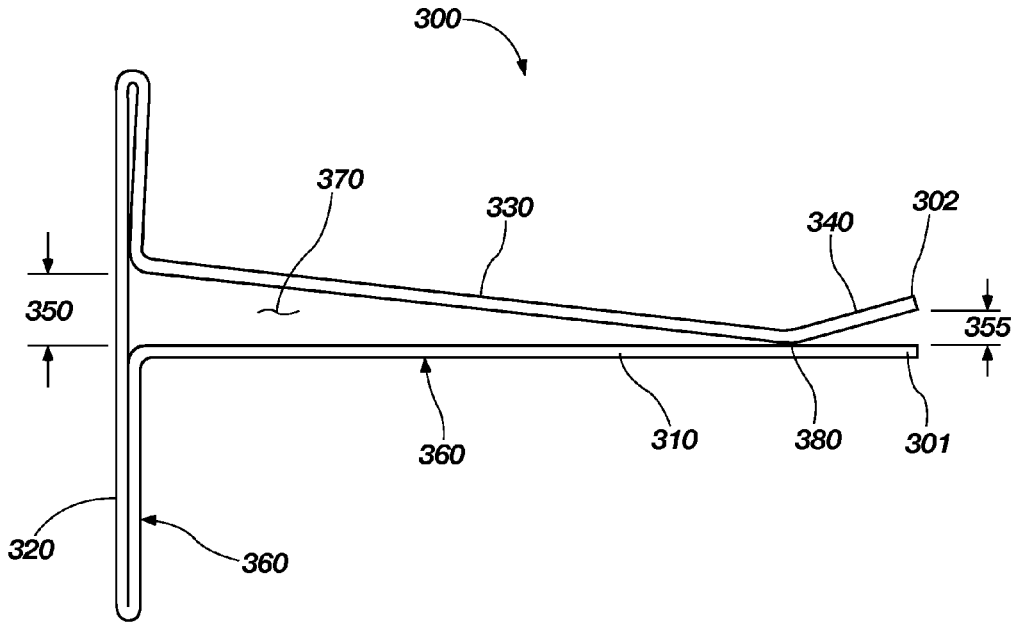
FIG. 7 is an end view of an embodiment of a molding member of the movable partition system of FIG. 2.
Figure 8:
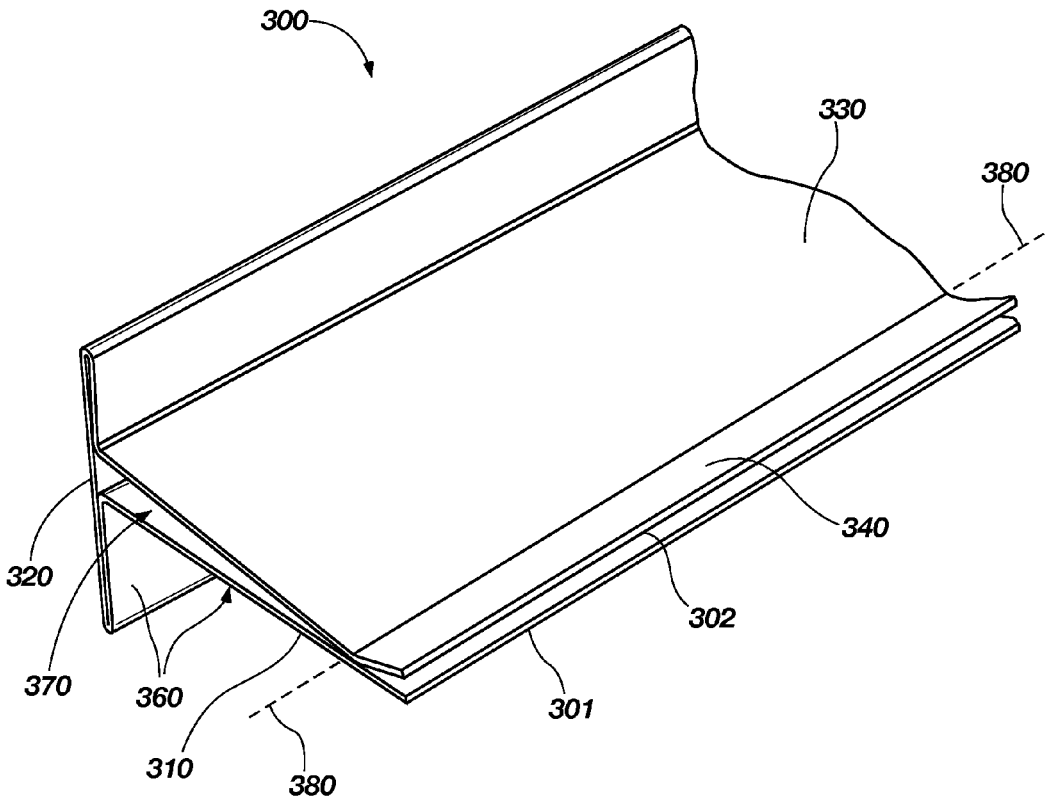
FIG. 8 is a partially cut-away perspective view of the molding member of FIG. 7.

Referring now to FIGS. 7 and 8, the movable partition system 100 may include a molding member 300. In general, the molding member 300 (and, similarly, the other embodiments 400, 500 to be described in more detail hereinafter) may be formed from a continuous sheet of material. The material used for the molding member 300 may be, by way of example, metal (e.g., steel, aluminum), ceramic, plastic, wood, or any combination thereof. For example, in some embodiments, the molding member 300 may be formed from a sheet of 24 gauge or 26 gauge cold rolled steel. The steel may be galvanized. In other embodiments, the molding member 300 may be formed from a sheet of a plastic material, such as polyvinyl chloride (PVC).

The molding member 300 may be formed by any suitable manufacturing technique, such as, for example, bending, molding, extruding, rolling, machining, etc. For example, in at least one embodiment, the structure and shape of the molding member 300 may be formed by bending portions of a single sheet of metal. By way of another example, one or more portions or features of the molding member 300 may be formed separately and later joined together. Such manufacturing techniques are known in the art and are not described in detail in this disclosure.

As illustrated in FIGS. 7 and 8, in some embodiments, the molding member 300 may include several regions or portions including an at least substantially flat base 310, an at least substantially flat back 320, and an at least substantially flat lever 330. The base 310 may be proximate a first longitudinally-extending end 301 of the molding member 300. The back 320 may be oriented at least substantially perpendicular to the base 310 and may be positioned proximate the base 310 opposite the first end 301 of the molding member 300. The lever 330 may extend from proximate the back 320 toward the base 310 at an angle relative to the base 310, leaving a first distance 350 between the lever 330 and the base 310 proximate the back 320. The lever 330 may be configured to touch or be proximate the base 310 at a line of contact 380 proximate the first end 301 of the molding member 300. In some embodiments, the base 310 may extend from proximate the back 320 approximately parallel to the base 310.

At least one internal surface of the molding member 300 may define a space 370 (e.g., an approximately triangular space). For example, internal surfaces of the base 310, a segment of the back 320, and the lever 330 may define the space 370. The space 370 may be configured to receive a portion of the soffit 140. The first distance 350 between the lever 330 proximate the back 320 and the base 310 may be any distance sufficient to enable insertion of a portion of the soffit 140 into the space 370. By way of example and not limitation, the first distance 350 may be in the range of from about 0.05 inch (1.27 mm) to about 0.2 inch (5.08 mm).

The molding member 300 may also include a lip 340 between a second longitudinally-extending end 302 of the molding member 300 and the lever 330. The lip 340 may extend from the line of contact 380 between the base 310 and the lever 330 away from the base 310 such that the first and second ends 301, 302 of the molding member 300 are separated by a second distance 355. The second distance 355 may be provided to improve the ease of insertion of the second lateral end 142 of the soffit 140, optionally including the fold 148 (FIGS. 5 and 6), between the first and second ends 301, 302 of the molding member. By way of example and not limitation, the second distance 355 may be in the range of from about 0.05 inch (1.27 mm) to about 0.2 inch (5.08 mm).

The lever 330 may extend at an angle (e.g., in a range of from about 1 degree to about 30 degrees) away from the base 310. The back 320 may extend beyond a plane of the base 310 in a first direction (e.g., down when viewed in FIG. 7) and in a second direction opposite the first direction (e.g., up when viewed in FIG. 7) and may extend beyond a plane formed by the lever 330 in both the first and the second directions. In other words, when viewed from a longitudinal end, the molding member 300 may have an overall shape approximating a capital letter "T."

The form and configuration of the molding member 300 (and, similarly, the other embodiments 400, 500 to be described in more detail hereinafter) may be such that the second end 302 of the molding member 300 is urged toward the first end 301 thereof by the resilience of the molding member 300. For example, bending of the lever 330 at a first end 334 thereof proximate the back 320 may pre-load the lever 330 causing it to press against the base 310 at the line of contact 380. However, some embodiments may not include a lever 330 that is pre-loaded. Pushing apart the lever 330 and the base 310 may cause at least some deformation of the molding member 300. Internal stresses in and resilience of the material of the molding member 300 may cause the lever 330 and the base 310 to exert a spring-like force toward each other.

Figure 11:
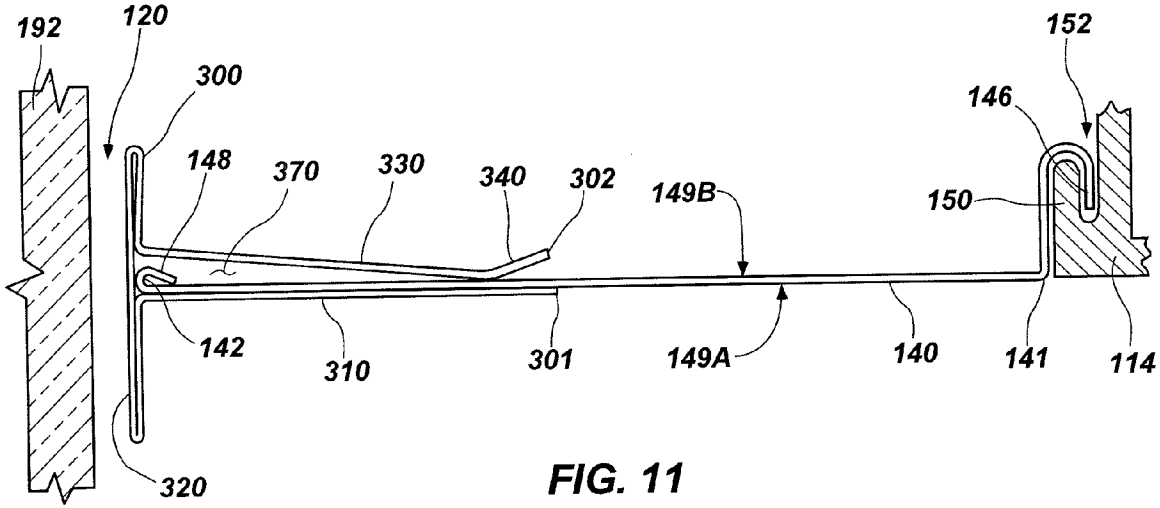
FIG. 11 is an end view of an engaged soffit and molding member at least partially installed in the movable partition system of FIG. 2.
Figure 12:
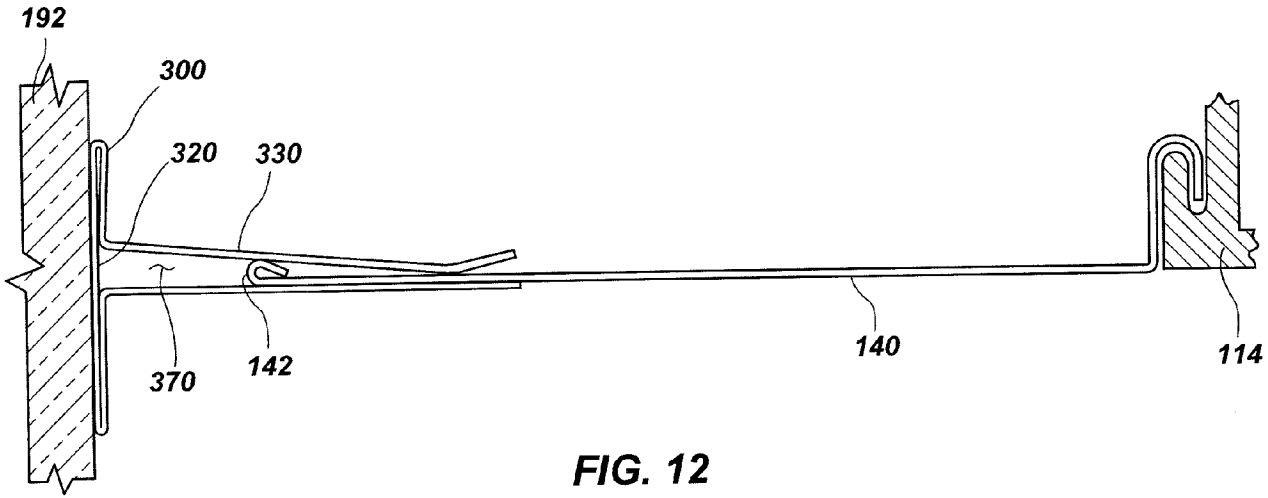
FIG. 12 is an end view of an engaged soffit and molding member of FIG. 11 with the molding member abutting a wall of the movable partition system of FIG. 2.

The molding member 300 may be configured to engage with the soffit 140 (see FIGS. 11 and 12). For example, the form and resilience of the molding member 300 may provide the ability to engage the molding member 300 with the soffit 140. The space 370 between the lever 330, the back 320, and the base 310 may be configured to receive a portion of the soffit 140. The resilience of the molding member 300 and the resulting spring-like force between the lever 330 and the base 310 may help maintain engagement between the molding member 300 and the soffit 140, as will be explained in further detail hereinafter with reference to FIG. 11.

Referring again to FIGS. 7 and 8, surfaces 360 of the molding member 300 may be exposed when the molding member 300 is installed in the header structure 190 of the movable partition system 100. Therefore, the exposed surfaces 360 may be treated (e.g., painted, polished, etc.) to improve their aesthetics. By way of example, the surfaces 360 may be painted to match or be complementary to surrounding surfaces (e.g., surfaces of the wall 192, a ceiling, the track 114, etc.).

Figure 9:
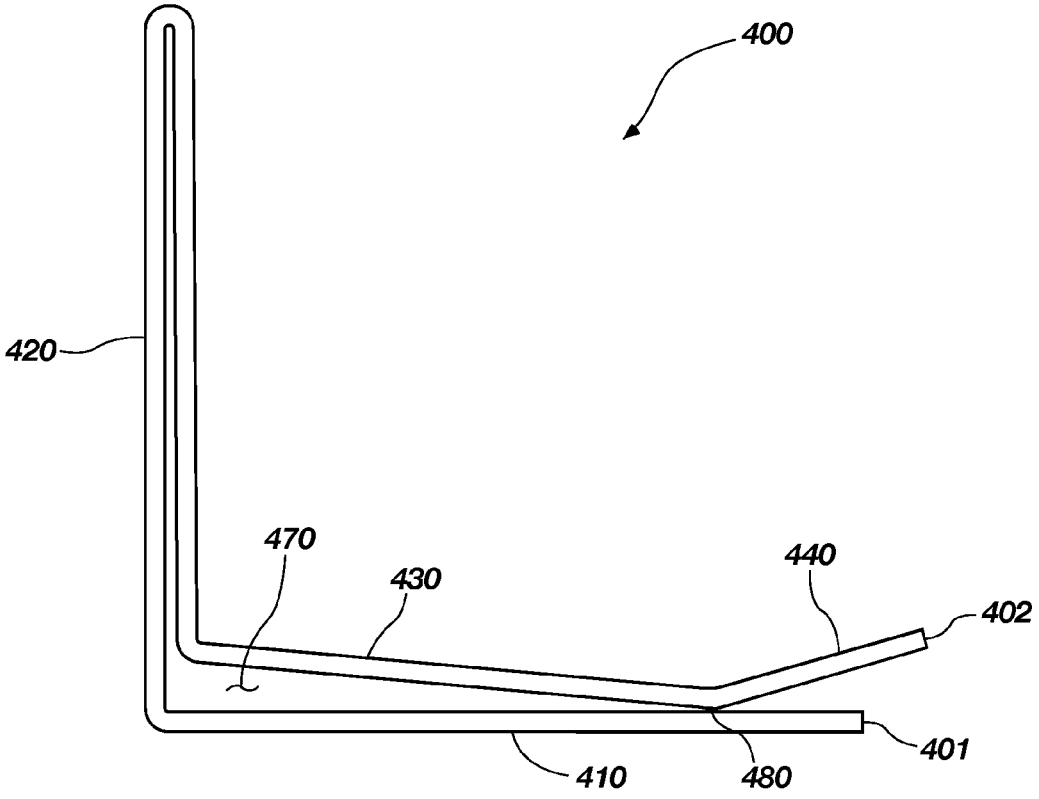
FIG. 9 is an end view of a second embodiment of a molding member of the movable partition system of FIG. 2.

A second embodiment of the molding member 400 (also referred to as the "second molding member 400") is illustrated in FIG. 9. The second molding member 400 may have a similar form to the molding member 300 illustrated in FIGS. 7 and 8 in some aspects. For example, the second molding member 400 may include an at least substantially flat base 410 proximate a first longitudinally-extending end 401 of the second molding member 400, an at least substantially flat back 420 oriented at least substantially perpendicular to the base 410, an at least substantially flat lever 430 extending from proximate the back 420 toward the first end 401 of the second molding member 400, and a lip 440 between the lever 430 and a second longitudinally-extending end 402 of the second molding member 400. The lever 430 may extend at an angle relative to the base 410 such that a space 470 (e.g., an approximately triangular space) is defined between the lever 430, a segment of the back 420, and the base 410. The space 470 may be configured to receive a portion of the soffit 140. The lever 430 may contact the base 410 along a line of contact 480. The back 420 may extend beyond a plane formed by the lever 430 in both directions (i.e., up and down when viewed in FIG. 9). The back 420 may also extend beyond a plane formed by the base 410 in a first direction (i.e., up when viewed in FIG. 9).

However, unlike the back 320 of the molding member 300 illustrated in FIGS. 7 and 8, the back 420 of the second molding member 400 may not extend beyond the plane formed by the base 410 in a second direction (i.e., down when viewed in FIG. 9). In other words, when viewed from a longitudinal end, the second molding member 400 may have an overall shape approximating a capital letter "L."

Figure 10:
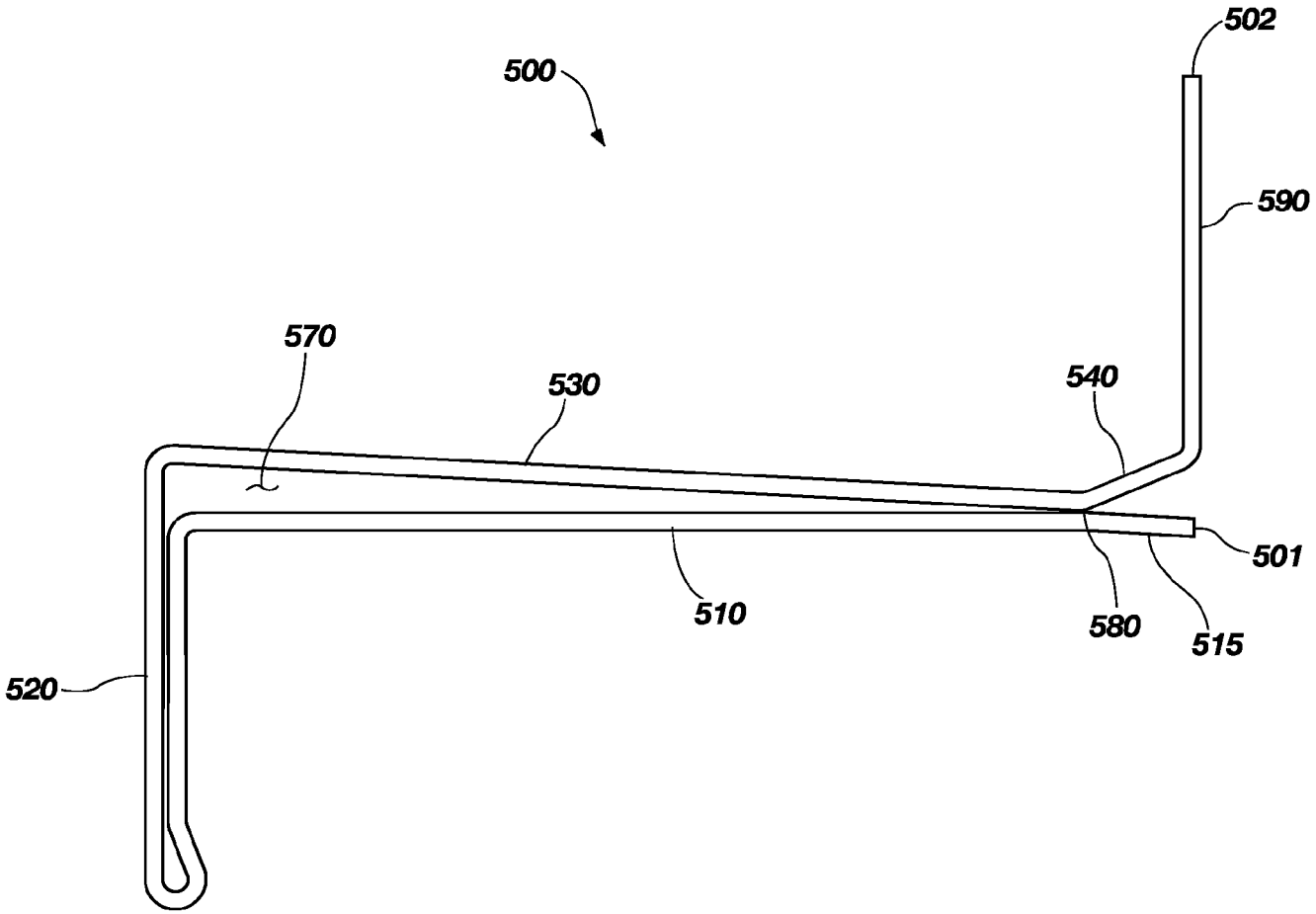
FIG. 10 is an end view of a third embodiment of a molding member of the movable partition system of FIG. 2.

A third embodiment of the molding member 500 (also referred to as the "third molding member 500") is illustrated in FIG. 10. The third molding member 500 may have a similar form to the molding member 300 illustrated in FIGS. 7 and 8 in some aspects. For example, the third molding member 500 may include an at least substantially flat base 510 proximate a first longitudinally-extending end 501 of the third molding member 500, an at least substantially flat back 520 oriented at least substantially perpendicular to the base 510, an at least substantially flat lever 530 extending from proximate the back 520 toward the first end 501 of the third molding member 500, and a lip 540 between the lever 530 and a second longitudinally-extending end 502 of the third molding member 500. The lever 530 may extend at an angle relative to the base 510 such that a space 570 (e.g., an approximately triangular space) is defined between the lever 530, a segment of the back 520, and the base 510. The space 570 may be configured to receive a portion of the soffit 140. The lever 530 may contact the base 510 along a line of contact 580. The back 520 may extend beyond a plane formed by the base 510 in both directions (i.e., up and down when viewed in FIG. 9). The back 520 may also extend beyond a plane formed by the lever 530 in a first direction (i.e., down when viewed in FIG. 9).

However, unlike the back 320 of the molding member 300 illustrated in FIGS. 7 and 8, the back 520 of the third molding member 500 may not extend beyond the plane formed by the lever 530 in a second direction (i.e., up when viewed in FIG. 9). The third molding member 500 may also include an at least substantially flat front 590 extending between the lip 540 and the second end 502 of the third molding member 500 and oriented at least substantially perpendicular to the base 510. In other words, when viewed from a longitudinal end, the third molding member 500 may have an overall shape approximating a capital letter "Z."

The front 590 may be used for any number of purposes, including, for example, as a lateral stop for the third molding member 500. In other words, when a soffit 140 engaged with the third molding member 500 is installed in a movable partition system 100, the front 590 may abut against a component of the movable partition system 100, such as the track 114 or the structural element 196 (see FIG. 4). By way of another example, the front portion 590 may be used by a person engaging the third molding member 500 with the soffit 140 as a grip to spread apart the first and second ends 501, 502 of the third molding member 500 for inserting a portion of the soffit 140 therethrough and into the space 570.

The third molding member 500 may also include an end portion 515 located at or near the first end 501 of the third molding member 500. The end portion 515 may be oriented at an angle relative to the base 510. By way of example, the end portion 515 may be at an angle relative to the base 510 in the range of from about 1 degree to about 30 degrees. The angle and orientation of the end portion 515 may provide a larger space (relative to an embodiment lacking the angled end portion 515) through which the portion of the soffit 140 may pass upon insertion therethrough.

Referring again to FIG. 4 in conjunction with FIGS. 7 through 10, any of the embodiments of the molding member 300, 400, 500 illustrated or their functional equivalents may be used in the header structure 190 of the movable partition system 100. Furthermore, features or portions of two or more of the embodiments 300, 400, 500 described hereinabove may be combined to form another embodiment of the molding member. The particular molding member used in a given embodiment of the movable partition system 100 may depend on space constraints, cost of materials, configuration of the movable partition system 100, aesthetics, or any other consideration that may be apparent to one skilled in the art.

The disclosure also includes methods of installing a movable partition system 100 in a building and methods of forming a header structure 190. Referring now to FIGS. 11 and 12 in conjunction with FIG. 4, the methods may include disposing the track 114 for a movable partition between the walls 192 of a header structure 190. In other words, the track 114 may be disposed at least partially in the header recess 191 of the header structure 190. Disposing the track 114 between the walls 192 may include suspending the track 114 from an overhead support member 198.

In some embodiments, the methods may further include engaging a molding member 300 with a soffit 140. Although reference is made to the molding member 300 for purposes of illustration, it is to be understood that any of the embodiments of the molding member 300, 400, 500 or their functional equivalents may be used in the method without exceeding the scope of the disclosure. Engaging the molding member 300 with the soffit 140 may include inserting a portion of the soffit 140 into the space 370 between the lever 330 and the base 310. For example, the first and second ends 301, 302 of the molding member 300 may be forced apart causing the lever 330 to lose contact with the base 310 at the line of contact 380. In some embodiments, the first and second ends 301, 302 of the molding member 300 may be forced apart by laterally pressing (e.g., pressing to the left as viewed in FIG. 11) the second lateral end 142 of the soffit 140 against the lip 340 of the molding member 300. Laterally pressing the second lateral end 142 of the soffit 140 against the lip 340 may cause the lip 340 and at least a portion of the lever 330 to lift away from the base 310. The portion of the soffit 140 including the second lateral end 142 may then be inserted into the space 370 defined by at least one internal surface of the molding member 300.

The base 310 of the molding member 300 may at least partially abut against the first surface 149A of the soffit 140 and the lever 330 of the molding member 300 may resiliently push against the second surface 149B of the soffit 140 to maintain engagement of the molding member 300 with the soffit 140. The molding member 300 and the soffit 140 engaged in this manner may be at least partially adjustable relative to one another in lateral and longitudinal directions (e.g., when viewed in FIG. 11, left and right and in and out of the page), but restricted in relative movement in a direction perpendicular to the lateral and longitudinal directions (e.g., when viewed in FIG. 11, up and down).

In embodiments that include a fold 148 along the second lateral end 142 of the soffit 140, the fold 148 may provide a bump or stop requiring the lever 330 to deflect away from the base 310 when inserting or removing the soffit 140 farther than if the fold 148 were not present. A greater force is required to obtain this increased deflection compared to a smaller deflection. Thus, the fold 148 may also help maintain engagement between the molding member 300 and the soffit 140.

The methods of the present disclosure may also include installing the soffit 140 and the molding member 300 to at least partially cover the space 136 (FIG. 4) between the track 114 and the wall 192. As described hereinabove, installing the soffit 140 and the molding member 300 may include coupling the soffit 140 with the track 114. For example, an attachment feature 146 of the soffit 140 may be coupled with a soffit attachment feature 150 along an outer, lateral edge of the track 114. The attachment feature 146 of the soffit 140 may wrap over and around the soffit attachment feature 150 on the track 114 and be disposed at least partially in the slot 150 formed by the hook shape of the soffit attachment feature 150 on the track 114. In other words, the soffit 140 may be fixed relative to the track 114. Alternatively, installing the soffit 140 and the molding member 300 may include coupling the soffit 140 with the header structure 190 (e.g., with the wall 192 of the header structure 190), as described hereinabove. In other words, the orientation of the soffit 140 and the molding member 300 may be switched 180 degrees relative to the wall 192 and the track 114 when viewed from the perspectives of FIGS. 4, 11, and 12.

The molding member 300 may be engaged with the soffit 140 either before or after coupling the soffit 140 with the track 114. In some embodiments, the molding member 300 may be engaged with the soffit 140 before coupling the soffit 140 with the track 114. After engaging the molding member 300 with the soffit 140 (e.g., inserting a portion of the soffit 140 in the molding member 300) the soffit 140 and the molding member 300 may be installed together to at least partially cover the space 136 (FIG. 4) between the track 114 and the wall 192.

As illustrated in FIG. 11, a space 120 may remain between the wall 192 and the second lateral end 142 of the soffit 140 in at least one location along the wall 192. In such locations, the molding member 300 may be adjusted laterally to cover the space 120 between the first wall and the second lateral end 142 of the soffit 140, as shown in FIG. 12. In other words, the molding member 300 may be pushed laterally (e.g., to the left as viewed in FIGS. 11 and 12) toward the wall 192. Pushing the molding member 300 laterally may cause the molding member 300 to slide laterally along the soffit 140 toward the wall 192 until the back 320 of the molding member 300 abuts against the wall 192. Thus, the space 120 between the second lateral end 142 of the soffit 140 and the wall 192 may be covered by the molding member 300. The space 136 (FIG. 4) between the track 114 and the wall 192 may be substantially fully covered by the soffit 140 and the molding member 300.

In some embodiments, a fastener, such as a screw, bolt, rivet, clip, wall mount etc., and/or an adhesive (not shown) may be used to secure the back 320 of the molding member 300 against the wall 192. However, in other embodiments, the fastener or adhesive may be omitted. In other words, at least portions of the molding member 300 may remain abutted against the wall 192 without attaching or fastening the molding member 300 to the wall 192 using a fastener or an adhesive. The resilience of the molding member 300, as described in more detail hereinabove, may hold the molding member 300 in a fixed position relative to the soffit 140. As the soffit 140 is fixed relative to the track 114 and consequently the rest of the header structure 190 (FIG. 4) including the wall 192, the molding member 300 may remain fixed in its position relative to the wall 192.

Figure 13:
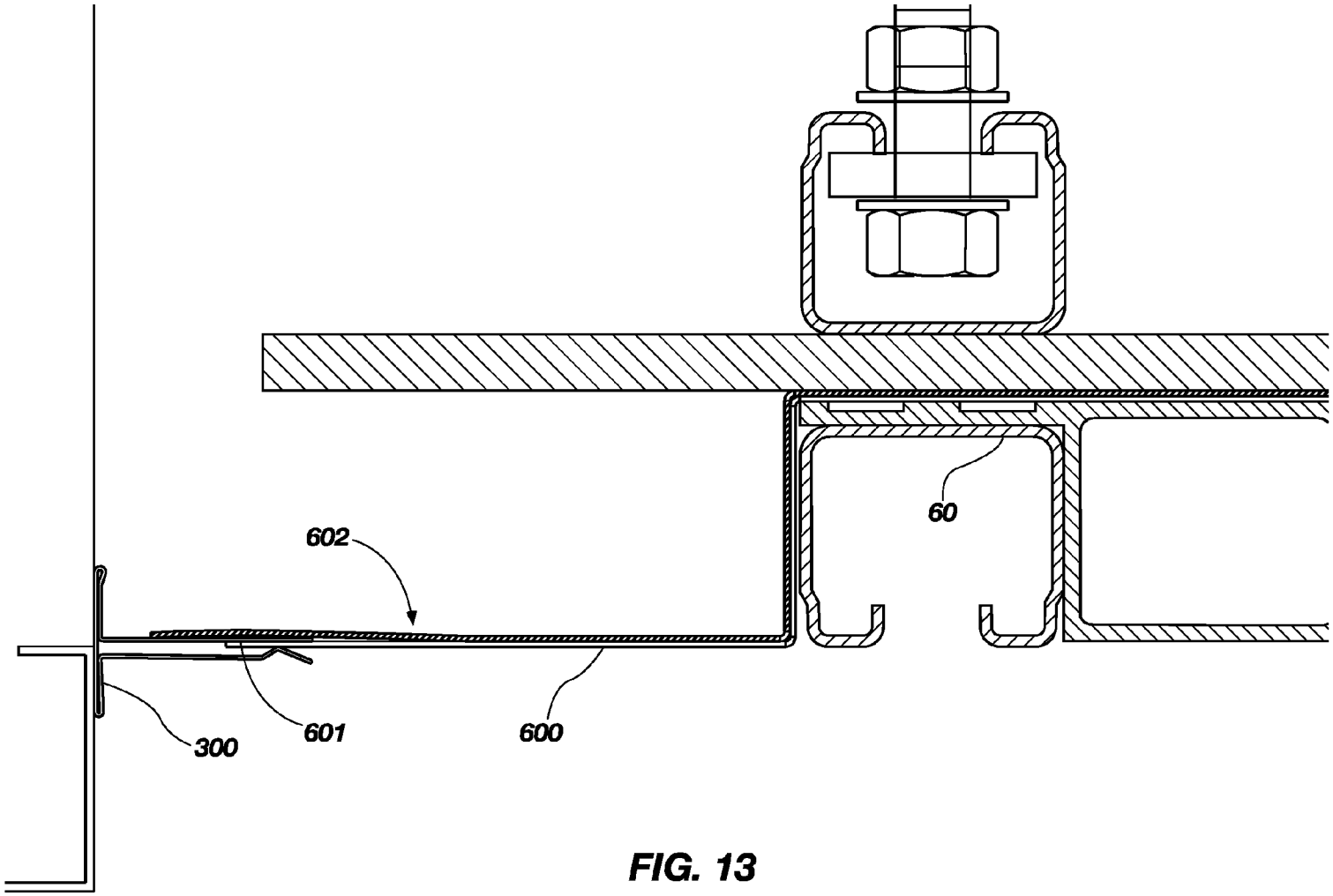
FIG. 13 is an end view illustrating a molding member like that of FIGS. 7 and 8 engaged with a metal header pan.

Recently, header assemblies for movable partition systems have been developed that include so called "header pans," as disclosed in U.S. Patent Application Publication No. 2010/0299889, published Dec. 2, 2010, now U.S. Pat. No. 8,051,616, issued Nov. 8, 2011, and entitled "Movable Partitions, Header Assemblies for Movable Partitions, and Related Methods," the disclosure of which is hereby incorporated herein in its entirety by this reference. In additional embodiments, molding members as disclosed herein may be employed in conjunction with such header assemblies. For example, FIG. 13 illustrates a molding member 300 engaged with a header pan section 600 and covering the space 120 between a wall and a lateral end 601 of the header pan section 600. In some embodiments, a portion of the molding member 300 may extend between the header pan section 600 and a header pan joint member 602 configured to cover joints between longitudinally adjacent header pan sections 600, as shown in FIG. 13. The molding member 300 may be installed and used as previously described herein with reference to other embodiments.

Figure 14:
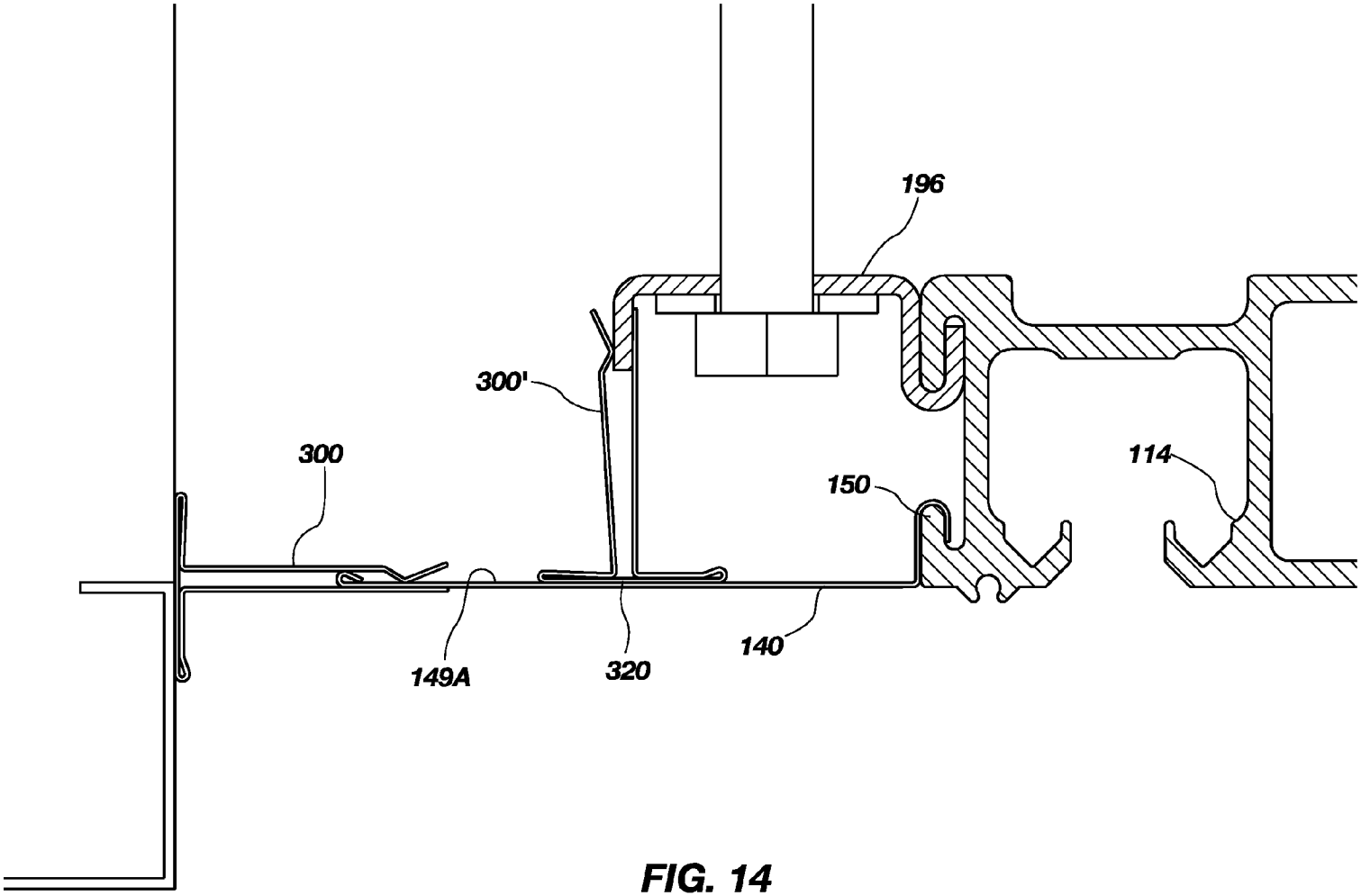
FIG. 14 is an end view illustrating two molding members like that of FIGS. 7 and 8, one of which is engaged with a soffit as shown in FIG. 12, and the other of which is engaged with a track suspension bracket and abuts against an upper surface of the soffit.

FIG. 14 illustrates yet another embodiment similar to that previously described with reference to FIGS. 11 and 12, but wherein an additional molding member 300' is coupled with a structural element 196 (e.g., a track suspension bracket) as shown in FIG. 14. The additional molding member 300' is oriented perpendicular to the orientation of the first molding member 300 that is engaged with the soffit 140. The additional molding member 300' may be vertically oriented, and the first molding member 300 may be horizontally oriented, as shown in FIG. 14. The back surface 320 of the additional molding member 300' may abut against the upper first surface 149A of the soffit 140, and may be used to stabilize the soffit 140 against forces applied to the soffit 140 that might otherwise disengage the soffit 140 from the soffit attachment feature 150 of the track 114. The back surface 320 may or may not be bonded, attached, or otherwise secured to the first surface 149A of the soffit 140. For example, in some embodiments, an adhesive and/or screws may be used to fasten the additional molding member 300' to the soffit 140. The additional molding member 300' may extend continuously along a length of the track 114, or two or more additional molding members 300' may be positioned such that they extend along segmented lengths in a discontinuous manner along the length of the track 114. The one or more additional molding members 300' may be engaged with the structural element 196 prior to installing the soffit 140 and the molding member 300.

Advantages of the methods of this disclosure over prior known methods may include ease and lower cost of installation. For example, engaging the molding member 300 with the soffit 140 in the manner disclosed may enable abutting the molding member 300 against the wall 192 despite imperfections in the wall 192 and reduce or eliminate the need for time-consuming and/or costly measurements, adjustments, custom fitting, etc. In addition, in some embodiments, there may be no need to attach the molding member 300 to the wall 192 with a fastener and/or an adhesive, reducing the time and cost of installation. Additionally, the soffit 140 and the molding member 300 may also be easily removed from the movable partition system 100 for maintenance or for other reasons without the need to remove or loosen fasteners and/or adhesive.

CONCLUSION

In some embodiments, the disclosure includes movable partition systems including a movable partition coupled with and movable along a track, a soffit positioned along an outer, lateral edge of the track, and a molding member engaged with the soffit. The molding member is configured to be adjusted laterally relative to the soffit. The molding member is at least partially abutted against a wall laterally adjacent the track. The molding member may, in some embodiments, include a base at least partially abutted against a first surface of the soffit, a lever resiliently pushing against a second surface of the soffit opposite the first surface, and a back at least partially abutted against the wall.

In additional embodiments, the disclosure includes methods of installing a movable partition system. In accordance with such methods, a track is suspended from a support member, a lateral end of a soffit is inserted between first and second longitudinally-extending ends of a molding member, and the soffit is coupled to one of a lateral edge of the track and a wall of a header structure. A portion of the soffit may be disposed in a space defined by at least one internal surface of the molding member. In some embodiments, the lateral end of the soffit is inserted between the first and second longitudinally-extending ends of the molding member before the soffit is coupled to one of the lateral edge of the track and the wall of the header structure.

In yet additional embodiments, the disclosure includes methods of forming a header structure for a movable partition system. In accordance with such methods, a track is disposed at least partially within a header recess of a header structure. A molding member is engaged with a soffit along a lateral end of the soffit such that at least a portion of the molding member is able to be adjusted laterally relative to the soffit. The soffit is coupled with the track along an outer, lateral edge of the track and between the track and a wall of the header structure.

While the invention may be susceptible to various modifications and alternative forms, specific embodiments have been shown by way of example in the drawings and have been described in detail herein. However, the invention is not intended to be limited to the particular forms disclosed. Rather, the invention includes all modifications, equivalents, combinations, and alternatives falling within the spirit and scope of the invention as defined by the following appended claims.

What is claimed is:

1. A movable partition system comprising:

a movable partition coupled with and movable along a track, a lateral direction being at least substantially perpendicular to a length of the track;

a soffit positioned along an outer, lateral edge of the track; and a molding member engaged with the soffit along a lateral end of the soffit opposite the track and at least partially abutted against a wall laterally adjacent the track, the molding member configured to be adjusted laterally relative to the soffit when the soffit is positioned along the outer, lateral edge of the track, wherein the molding member is configured to remain at least partially abutted against the wall without attaching or fastening the molding member to the wall.

2. The movable partition system of claim 1, wherein the molding member comprises:

a base at least partially abutted against a first surface of the soffit;

a lever resiliently pushing against a second surface of the soffit opposite the first surface; and an at least substantially flat back at least partially abutted against the wall.

3. The movable partition system of claim 2, wherein the molding member is not fastened to the wall.

4. The movable partition system of claim 2, wherein the base is at least substantially flat and the back is oriented at least substantially perpendicular to the base.

5. The movable partition system of claim 2, wherein the molding member further comprises a lip proximate a longitudinally-extending end of the molding member opposite the base, the lip extending away from the base at an angle relative to the base.

6. The movable partition system of claim 1, wherein a portion of the soffit is disposed within a space defined by at least one internal surface of the molding member.

7. The movable partition system of claim 1, wherein:

the soffit covers a first portion of a space between the track and the wall; and the molding member at least substantially covers a remaining portion of the space between the track and the wall.

8. A method of installing a movable partition system, comprising:

suspending a track from a support member, a lateral direction being at least substantially perpendicular to a length of the track;

inserting a lateral end of a soffit between a first longitudinally-extending end and a second longitudinally-extending end of a molding member;

coupling an opposite lateral end of the soffit to an outer lateral edge of the track;

causing the molding member to at least partially abut against the wall of the header structure by laterally adjusting the molding member relative to the soffit after the opposite lateral end of the soffit is coupled to the outer lateral edge of the track, wherein the molding member is configured to remain at least partially abutted against the wall without attaching or fastening the molding member to the wall; and coupling a movable partition with the track, the movable partition movable along the track.

9. The method of claim 8, wherein inserting the lateral end of the soffit between the first and second longitudinally-extending ends of the molding member comprises causing a base of the molding member proximate the first longitudinally-extending end and a lever of the molding member proximate the second longitudinally-extending end to contact the soffit on opposing surfaces of the soffit.

10. The method of claim 9, wherein inserting the lateral end of the soffit between the first and second longitudinally-extending ends of the molding member further comprises disposing a portion of the soffit in a space defined by at least one internal surface of the molding member.

11. The method of claim 8, wherein coupling an opposite lateral end of the soffit to the outer lateral edge of the track comprises inserting at least a portion of an engagement feature of the soffit into a longitudinally-extending slot on the outer, lateral edge of the track.

12. The method of claim 8, wherein coupling the soffit to one of the lateral edge of the track and the wall of the header structure comprises coupling the soffit to one of the lateral edge of the track and the wall of the header structure after inserting the lateral end of the soffit between the first and second longitudinally-extending ends of the molding member.

13. The method of claim 8, wherein coupling the soffit to the lateral edge of the track comprises coupling the soffit to the lateral edge of the track after inserting the lateral end of the soffit between the first and second longitudinally-extending ends of the molding member.

14. A method of forming a header structure for a movable partition system, the method comprising:

disposing a track for a movable partition at least partially within a header recess of a header structure, a lateral direction being at least substantially perpendicular to a length of the track;

engaging a molding member with a soffit along a lateral end of the soffit such that at least a portion of the molding member is able to be adjusted laterally relative to the soffit;

coupling an opposite lateral end of the soffit with the track along an outer, lateral edge of the track and between the track and a wall of the header structure;

abutting at least a portion of the molding member against the wall of the header structure by adjusting the molding member laterally relative to the soffit after the opposite lateral end of the soffit is coupled with the track along the outer, lateral edge of the track, wherein the molding member is configured to remain at least partially abutted against the wall without attaching or fastening the molding member to the wall; and coupling a movable partition with the track, the movable partition movable along the track.

15. The method of claim 14, wherein abutting at least a portion of the molding member against the wall comprises abutting at least a portion of the molding member against the wall without attaching the molding member to the wall using a fastener or an adhesive.

16. The method of claim 14, wherein engaging the molding member with the soffit comprises engaging the molding member with the soffit before coupling the soffit with the track.

17. The method of claim 14, wherein engaging the molding member with the soffit comprises inserting a portion of the soffit in a space defined by at least one internal surface of the molding member.

18. The movable partition system of claim 2, wherein the molding member is formed from a continuous sheet of material.

19. The movable partition system of claim 1, further comprising:

a track suspension bracket coupled with and vertically supporting the track; and an additional molding member coupled to the track suspension bracket, the additional molding member comprising a back surface abutted against the soffit to stabilize the soffit relative to the track suspension bracket.

20. The movable partition system of claim 1, wherein the molding member is vertically supported solely by the soffit.

* * * * *